US008791973B2

(12) United States Patent
Matsushita et al.

(10) Patent No.: US 8,791,973 B2
(45) Date of Patent: Jul. 29, 2014

(54) IMAGE FORMING APPARATUS

(71) Applicants: Yuichi Matsushita, Nagoya (JP); Toshio Furukawa, Nagoya (JP); Yosuke Sugiyama, Gifu (JP); Minoru Matsuura, Nagoya (JP)

(72) Inventors: Yuichi Matsushita, Nagoya (JP); Toshio Furukawa, Nagoya (JP); Yosuke Sugiyama, Gifu (JP); Minoru Matsuura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/849,593

(22) Filed: Mar. 25, 2013

(65) Prior Publication Data

US 2013/0258024 A1 Oct. 3, 2013

(30) Foreign Application Priority Data

Mar. 28, 2012 (JP) ..... 2012-072914

(51) Int. Cl.

| | |
|---|---|
| ***B41J 15/14*** | (2006.01) |
| ***B41J 2/435*** | (2006.01) |
| ***B41J 2/455*** | (2006.01) |
| ***B41J 2/47*** | (2006.01) |
| ***B41J 27/00*** | (2006.01) |

(52) U.S. Cl.

USPC ..... 347/241; 347/228; 347/233; 347/239; 347/256

(58) Field of Classification Search

USPC ..... 347/228, 233, 239, 241, 256

See application file for complete search history.

(56) References Cited

U.S. PATENT DOCUMENTS

2010/0021186 A1* 1/2010 Okano ..... 399/21

FOREIGN PATENT DOCUMENTS

| | | | |
|---|---|---|---|
| JP | 06-008525 A | | 1/1994 |
| JP | 06008525 A | * | 1/1994 |
| JP | 2010-032722 A | | 2/2010 |

* cited by examiner

*Primary Examiner* — Sarah Al Hashimi

(74) *Attorney, Agent, or Firm* — Banner & Witcoff, Ltd.

(57) ABSTRACT

There is provided an image forming apparatus including plural photosensitive members on which developer images are formed by supplying developer to electrostatic latent images, respectively, an exposure device which illuminates light beams onto surfaces of the photosensitive members to form the electrostatic latent images, respectively. The developer images on the respective photosensitive numbers are transferred to a transferred medium which is moved in a moving direction while contacting the respective photosensitive members. The exposure device is configured such that a beam diameter of light beam exposing a most-upstream photosensitive member in the moving direction on a surface of the most-upstream photosensitive member is larger than a beam diameter of light beam exposing a most-downstream photosensitive member in the moving direction on a surface of the most-downstream photosensitive member.

14 Claims, 8 Drawing Sheets

IMAGE FORMING APPARATUS

CROSS-REFERENCE TO RELATED APPLICATION

This application claims priority from Japanese Patent Application No. 2012-072911, filed on Mar. 28, 2012, the entire subject matter of which is incorporated herein by reference.

TECHNICAL FIELD

Aspects of the present invention relate to an image forming apparatus having a plurality of photosensitive members arranged in parallel.

BACKGROUND

There has been known a tandem-type image forming apparatus such as color printer in which photosensitive drums corresponding to respective colors of yellow, magenta, cyan and black are arranged side by side in a conveyance direction of a sheet (refer to JP-A-2010-32722). In this image forming apparatus, transfer rollers are provided in correspondence to the respective photosensitive drums and a transfer bias is applied to the transfer rollers, so that toner on the photosensitive drums is transferred to the sheet when the sheet is conveyed between the photosensitive drums and the transfer rollers.

In the tandem-type image forming apparatus, when toner of a first color transferred to the sheet is aggregated, a potential of the corresponding part could be increased. When it is intended to overlap and transfer toner of another color onto the toner of the first color having the increased potential, the toner of the other color would be scattered by the toner of the first color. This problem becomes conspicuous when a charge amount of the toner of the first color is increased (hereinafter, which is referred to as 'charge up') as the toner passes between a downstream photosensitive drum and a transfer roller, and the toner from the photosensitive drum arranged at the most downstream side is transferred with being overlapped onto the toner of the first color.

SUMMARY

Accordingly, an aspect of the present invention provides an image forming apparatus capable of favorably overlapping toner (developer).

According to an illustrative embodiment of the present invention, there is provided an image forming apparatus including a plurality of photosensitive members, and an exposure device. The plurality of photosensitive members are arranged in parallel and on which developer images are formed by supplying developer to electrostatic latent images, respectively. The exposure device is configured to illuminate light beams onto surfaces of the photosensitive members to form the electrostatic latent images, respectively. The developer images on the respective photosensitive members are transferred to a transferred medium which is moved in a moving direction along an arrangement direction of the photosensitive members while contacting the respective photosensitive members. The exposure device is configured such that a beam diameter of light beam exposing a most-upstream photosensitive member arranged at a most upstream side in the moving direction on a surface of the most-upstream photosensitive member is larger than a beam diameter of light beam exposing a most-downstream photosensitive member arranged at a most downstream side in the moving direction on a surface of the most-downstream photosensitive member.

According to the above configuration, the beam diameter of the light beam on the most-upstream photosensitive member is larger to increase an area of an illumination part (exposed part) of the light beam. Therefore, it is possible to suppress the developer, which is put on the exposed part, from being aggregated and to spread and put the developer on the corresponding part. Accordingly, since the developer which is transferred onto the transferred medium from the most-upstream photosensitive member is also spread and transferred, a layer thickness of the developer on the transferred medium becomes thin, so that increase of a potential of the corresponding part is suppressed. As a result, since the developer from the other photosensitive members can be easily put on the developer transferred at the most upstream side, it is possible to favorably overlap the developer.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

[First Illustrative Embodiment]

Hereinafter, a first illustrative embodiment of the present invention will be specifically described with reference to the accompanying drawings. Meanwhile, in the below descriptions, a schematic configuration of a color printer 1 (an example of an image forming apparatus) will be briefly described, and then, a configuration of an exposure device 5 will be specifically described. Also, in the below descriptions, the directions are described on the basis of a user who uses the color printer 1. That is, the left of FIG. 1 is referred to as the 'front,' the right of FIG. 1 is referred to as the 'rear,' the front side of FIG. 1 is referred to as the 'right' and the back side of FIG. 1 is referred to as the 'left.' Also, the upper and lower directions of FIG. 1 are referred to as the 'upper-lower.'

<Schematic Configuration of Color Printer>

Figure 1:
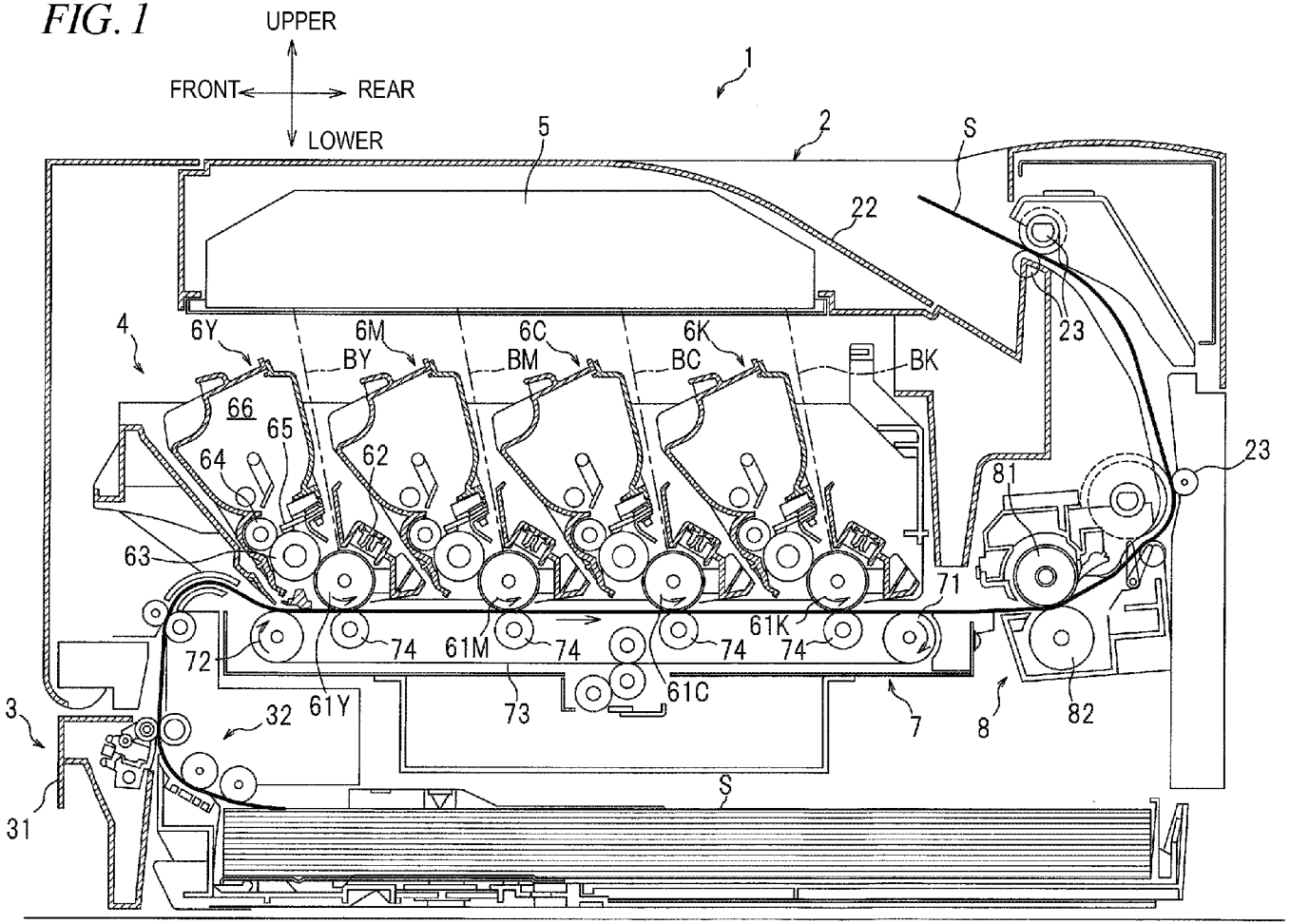
FIG. 1 shows a schematic configuration of a color printer which is an example of an image forming apparatus according to an illustrative embodiment of the present invention.

As shown in FIG. 1, the color printer 1 includes, in a body housing 2, a feeder unit 3 which feeds a sheet S and an image forming unit 4 which forms an image on the fed sheet S. The image forming unit 4 includes an exposure device 5, four process units 6, a transfer unit 7 and a fixing unit 8.

The feeder unit 3 is provided at the lower in the body housing 10 and includes a sheet feeding tray 31 which accommodates therein the sheet S (an example of a transferred medium), and a sheet feeding mechanism 32 which feeds the sheet S from the sheet feeding tray 31 to the image forming unit 4, The sheets S in the sheet feeding tray 31 are separated and fed one by one to the image forming unit 4 by the sheet feeding mechanism 32.

The exposure device 5 is provided at the upper in the body housing 2 and is configured to illuminate light beams B based on print data onto surfaces of respective photosensitive drums 61 to thus expose the surfaces of the photosensitive drums 61, thereby forming electrostatic latent images thereon. The exposure device 5 will be specifically described later.

The four process units 6 are arranged in parallel in the front-rear direction between the sheet feeding tray 31 and the exposure device 5. Each process unit 50 includes the photosensitive drum 61 (an example of a photosensitive member), a charger 62, a developing roller 63, a supply roller 64, a layer thickness regulation blade 65 and a toner accommodation part 66 which accommodates therein positively chargeable toner (developer).

The process units 6 are arranged side by side from the front side (upstream side of the conveyance direction of the sheet S) in order of the process units 6Y, 6M, 6C, 6K in which yellow, magenta, cyan and black toner (not shown) are respectively accommodated. Meanwhile, in the specification and drawings, when specifying the photosensitive drum 61 and the like in correspondence to the color, of the toner, the reference numerals Y, M, C, K are denoted for yellow, magenta, cyan and black, respectively.

The transfer unit 7 is provided between the sheet feeding tray 31 and the process units 6 and includes a driving roller 71, a driven roller 72, an endless conveyance belt 73 which is wound around the driving roller 71, the driven roller 72 and four transfer rollers 74 in a tensioned state. The conveyance belt 73 has an outer surface which abuts on the respective photosensitive drums 61 and the respective transfer rollers 74 are arranged at an inside to sandwich the conveyance belt 73 between the transfer rollers 74 and the photosensitive drums 61.

The fixing unit 8 is provided at the rear of the process units 6 and the transfer unit 7 and includes a heating roller 81 and a pressing roller 82 which is arranged to face the heating roller 81 and presses the heating roller 81.

In the image forming unit 4, the surfaces of the photosensitive drums 61 are uniformly positively charged by the chargers 62 and then exposed by the scanning of the light beams B emitted from the exposure device 5, so that electrostatic latent images based on print data are formed on the photosensitive drums 61. The toner in the toner accommodation parts 66 is supplied to the developing rollers 63 via the supply rollers 64 and is introduced between the developing rollers 63 and the layer thickness regulation blades 65, so that it is carried on the developing rollers 63 as a thin layer having a predetermined thickness. In this process, the toner is positively friction-charged between the developing rollers 63 and the supply rollers 64 between the developing rollers 63 and the layer thickness regulation blades 65, and the like. Then, the toner carried on the developing rollers 63 is supplied to the electrostatic latent images formed on the photosensitive drums 61, so that the electrostatic latent images become visible and toner images (developer images) are formed on the photosensitive drums 61.

The sheet S Which is fed from the feeder unit 3 is moved from the front towards the rear (the one side of the arrangement direction of the photosensitive drums 61) on the conveyance belt 73 while contacting the respective photosensitive drums 61. During this movement, the toner images on the respective photosensitive drums 61 are sequentially transferred onto the sheet S with being overlapped between the photosensitive drums 61 and the transfer rollers 74 to which a transfer bias is applied. The sheet S having the toner images transferred thereto passes between the heating roller 81 and the pressing roller 82, so that the toner images are heat-fixed. Then, the sheet is discharged to the outside from the body housing 2 by conveyance rollers 23 and is placed on a sheet discharge tray 22.

<Specific Configuration of Exposure Device>

Figure 2:
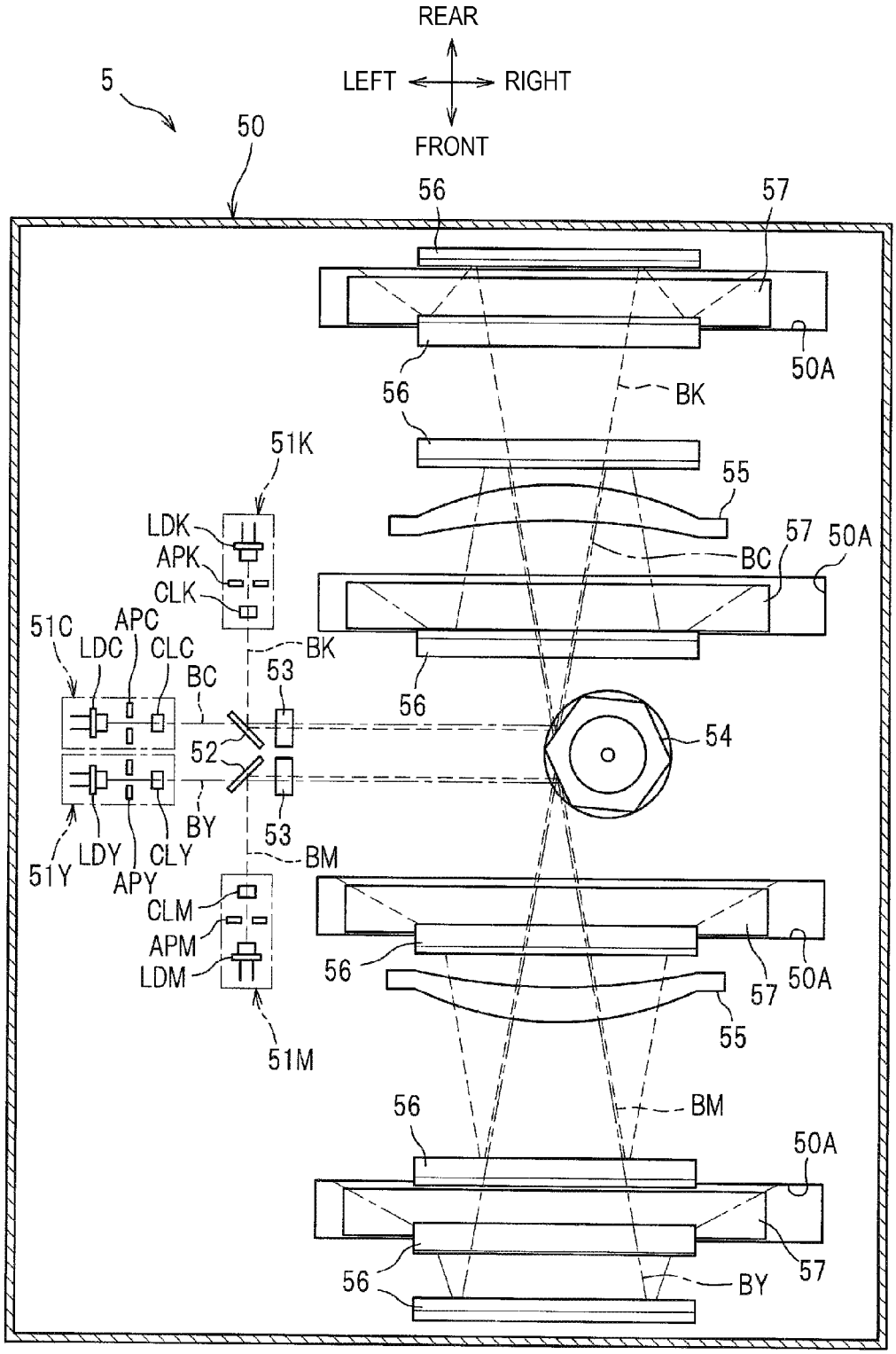
FIG. 2 is a plan view of an exposure device of the color printer.
Figure 3:
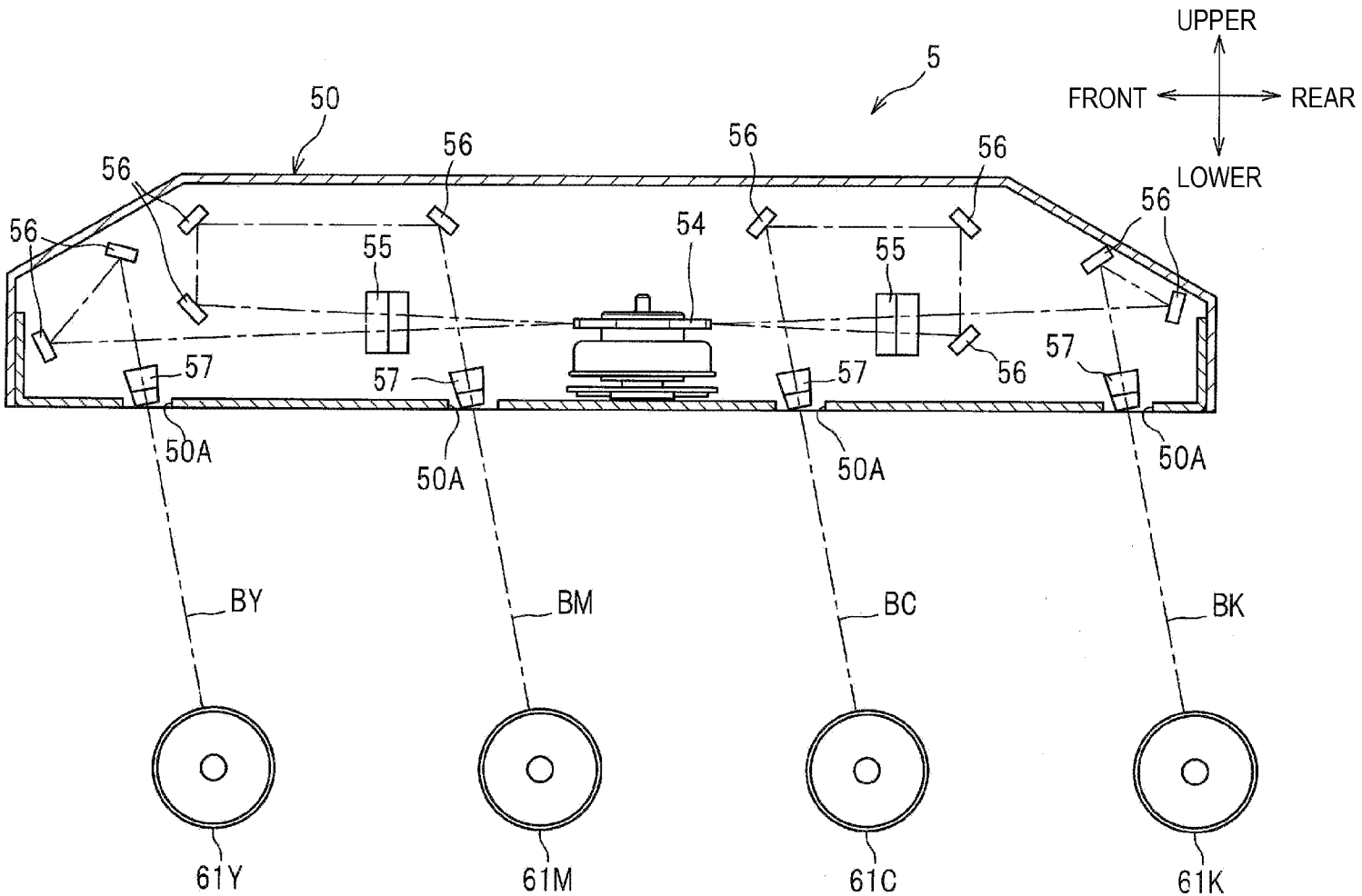
FIG. 3 is a sectional view of the exposure device.

As shown in FIGS. 2 and 3, the exposure device 5 includes, in a housing 50, four light source devices 51, two reflectors 52, two cylindrical lenses 53, a polygon mirror 54, two fθ lenses 55, a plurality of reflectors 56 and four correction lenses 57.

Each of the light source devices 51 emits the light beams B and includes, a semiconductor laser LD (an example of a light source), an aperture stop AP and a coupling lens CL. The aperture stop AP is a plate-shaped member having a substantially rectangular aperture and defines a diameter of the laser light emitted from the semiconductor laser LD. The coupling lens CL collects the light beam and converts it into a light beam (parallel light flux). The light source devices 51Y, 51C are arranged side by side in the front-rear direction. The light source devices 51M, 51K face each other in the front-rear direction and are arranged such that the light beams BM, BK emitted therefrom are orthogonal to the light beams BY, BC emitted from the light source devices 51Y, 51C.

The reflectors 52 reflect the light beams BM, BK emitted from the source devices 51M, 51K towards the polygon mirror 54. In the meantime, the light beams BY, BC emitted from the light source devices 51Y, 51C pass above the reflectors 52 and are incident on the polygon mirror 54.

The cylindrical lens 53 refracts the light beam B to thus converge it in a sub-scanning direction so as to correct a face tangle error of the polygon mirror 54, and forms an image in a linear shape which is long in a main scanning direction on a reflective surface of the polygon mirror 54.

The polygon mirror 54 has six mirror surfaces (reflective surfaces) provided at equal distance from a rotary shaft and reflects the light beams B having passed through the cylindrical lenses 53 to thus deflect them in the main scanning direction (left-right direction in FIG. 2) while the mirror surfaces rotate at constant speed about the rotary shaft.

The fθ lens 55 refracts the light beam B to thus converge it in the sub-scanning direction so as to correct a face tangle error of the polygon mirror 54, and forms an image in a point shape on the surface of the photosensitive drum 61. Also, the fθ lens 55 has an fθ characteristic of scanning the light beam B, which is scanned at a constant angular speed by the polygon mirror 54, at constant speed in the main scanning direction on the surface of the photosensitive drum 61.

The reflector 56 reflects the light beam B having passed through the ID lens 55 towards the correction lens 57.

The correction lens 57 refracts the light beam B to thus converge it in the sub-scanning direction so as to correct a face tangle error of the polygon mirror 54, and forms an image on the surface of the photosensitive drum 61.

In the exposure device 5, as shown in FIG. 2, the light beams BY BC emitted from the light source devices 51Y, 51C pass through the cylindrical lenses 53 and are deflected in the main scanning direction by the polygon mirror 54. The light beams BM, BK emitted from the light source devices 51M, 51K are reflected on the reflectors 52 to thus face the polygon mirror 54, pass through the cylindrical lenses 53 and are deflected in the main scanning direction by the polygon mirror 54. As shown in FIG. 3, the light beams B reflected by the polygon mirror 54 pass through the fθ lenses 55, are reflected on the reflectors 56, pass through the correction lenses 57 and exposure openings 50A formed on a bottom surface of the housing 50 and then scan and expose the surfaces of the photosensitive drums 61.

Figure 4A:
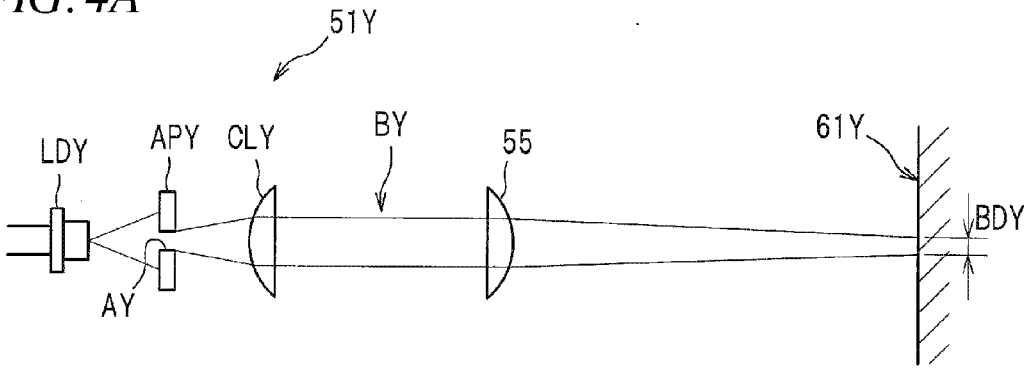
FIGS. 4A and 4B show a relation between a size of an aperture of an aperture stop and a size of a beam diameter of a light beam on a photosensitive drum.
Figure 4B:
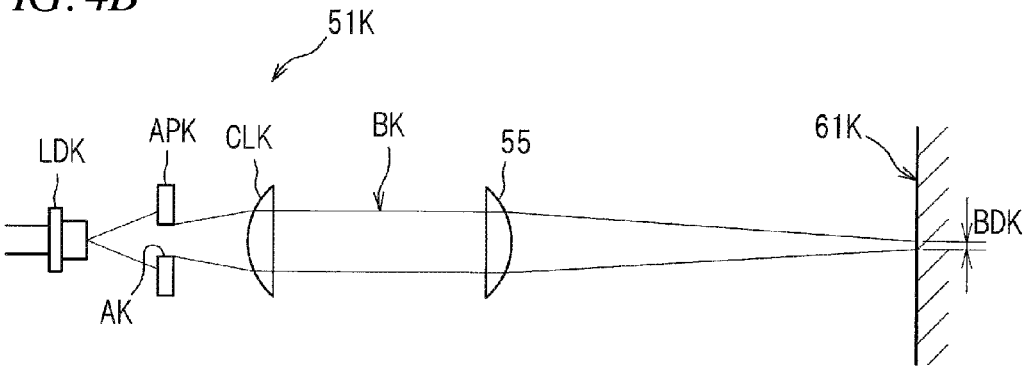

In this illustrative embodiment, the exposure device 5 is configured such that a beam diameter of the light beam BY exposing the photosensitive drum 61Y arranged at the most forward side (the most upstream side in the moving direction of the sheet S) on the surface of the photosensitive drum 61Y, becomes larger than a beam diameter of the light beam BK exposing the photosensitive drum 61K arranged at the most rearward side (the most downstream side in the moving direction of the sheet S) on the photosensitive drum 61K. Specifically, as shown in FIGS. 4A and 4B, the aperture stop APY of the light source device 51Y emitting the light beam BY has an aperture AY having a size smaller than that of an aperture AK of the aperture stop APK of the light source device 51K emitting the light beam BK. For example, a size (width in the main scanning direction) of the aperture AY of the aperture stop APY is about 2.0 to 3.0 mm and a size (width in the main scanning direction) of the aperture AK of the aperture stop APK is about 4.2 mm.

Accordingly, a diameter of the laser light on the incident surface of the coupling lens CLY, which is emitted from the semiconductor laser LD and passes through the aperture AY of the aperture stop APY, is smaller than that of the laser light on the incident surface of the coupling lens CLK, which passes through the aperture AK. A beam diameter of the light beam BY after the conversion into the light beam (parallel light flux) by the coupling lens CL is also smaller than that of the light beam BK.

Here, the fθ lens 55 has a characteristic that when a beam diameter of the incident light beam is larger, a beam diameter of the light beam on the photosensitive drum 61 becomes smaller and when a beam diameter of the incident light beam is smaller, a beam diameter of the light beam on the photosensitive drum 61 becomes larger. Therefore, as the light beam BY having the smaller beam diameter is incident on the fθ lens 55, the beam diameter BDY of the light beam BY on the photosensitive drum 61Y becomes larger than the beam diameter BDK on the photosensitive drum 61K. For example, the beam diameter BDY is about 167 μm and the beam diameter BDK is about 60 μm. Meanwhile, in FIG. 4, the cylindrical lenses 53, the polygon mirror 54 and the like are not shown, and the beam diameter BD is more emphasized than in reality.

Also, in this illustrative embodiment, the semiconductor laser LDY of the light source device 51Y is set such that an output power is higher than that of the semiconductor laser LDK of the light source device 51K. Here, if the output power of the semiconductor laser LDY is same as that of the semiconductor laser LDK, since the aperture AY of the aperture stop APY is small, a light amount of the laser light passing through the aperture AY is reduced. Therefore, an intensity of the light beam BY on the photosensitive drum 61Y becomes smaller than that of the light beam BK on the photosensitive drum 61K. Thus, in this illustrative embodiment, the output power of the semiconductor laser LDY is set to be larger than that of the semiconductor laser LDK.

Figure 5A:
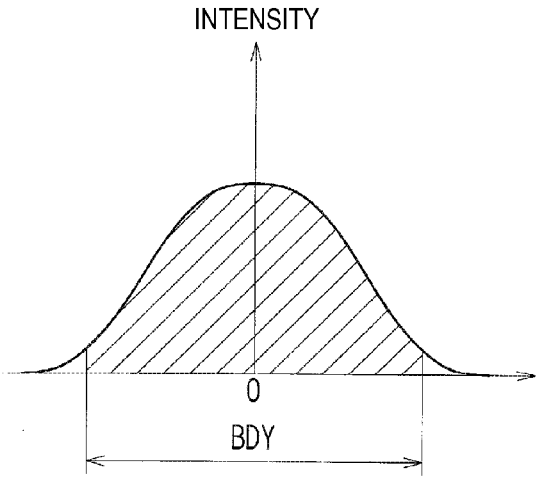
FIGS. 5A and 5B show a tendency of an intensity distribution of the light beam on the photosensitive drum.
Figure 5B:
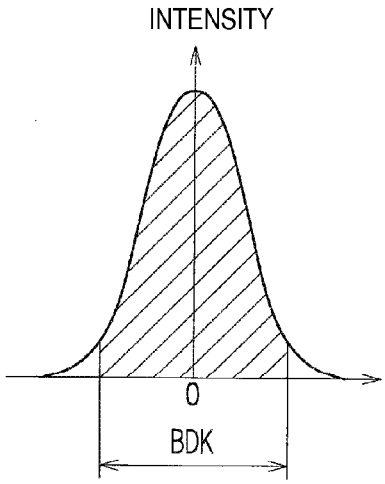

The output power of the semiconductor laser LDY is set such that the energy per unit time of the light beam on the photosensitive drum 61Y is substantially same as the energy per unit time of the light beam on the photosensitive drum 61K. Specifically, since an intensity distribution of the light beam BY on the photosensitive drum 61Y has a tendency as shown in FIG. 5A and an intensity distribution of the light beam BK on the photosensitive drum 61K has a tendency as shown in FIG. 5B, the output power of the semiconductor laser LDY is set to be larger than that of the semiconductor laser LDK such that a hatched area of FIG. 5A is substantially same as a hatched area of FIG. 5B.

Meanwhile, in this illustrative embodiment, sizes of apertures of the aperture stops APM, APC are same as that of the aperture AK of the aperture stop APK. Thereby, the beam diameters of the light beams BM, BC on the photosensitive drums 61M, 61C are same as that of the light beam BK on the photosensitive drum 61K. Also, the semiconductor lasers LDM, LDC of the light source devices 51M, 51C are set such that output powers thereof are same as that of the semiconductor laser LDK of the light source device 51K.

<Operational Effects>

Subsequently, operational effects of the above-described color printer 1 are described with reference to an example where the yellow toner is transferred onto the sheet S at the most upstream side in the moving direction, and then, the black toner is transferred with being overlapped on the yellow toner at the most downstream side in the moving direction.

Figure 6A:
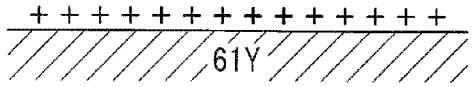
FIGS. 6A to 6G show operational effects of the color printer.
Figure 6B:
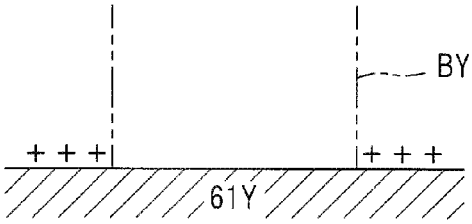

As shown in FIG. 6A, the surface of the photosensitive drum 61Y is uniformly positively charged just after it is charged by the charger 62. As shown in FIG. 6B, the surface of the photosensitive drum 61Y is exposed by the light beam BY illuminated from the exposure device 5, so that a potential of the exposed part is lowered and thus an electrostatic latent image is formed.

Figure 6E:
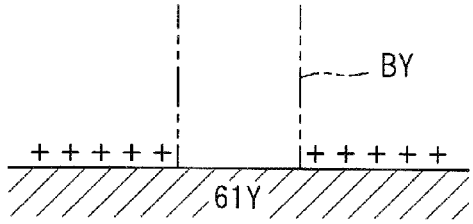
Figure 6C:
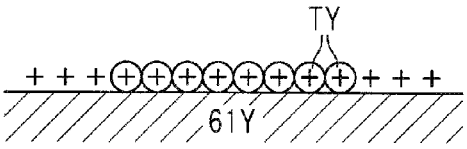
Figure 6F:
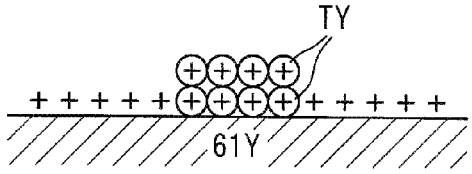
Figure 6D:
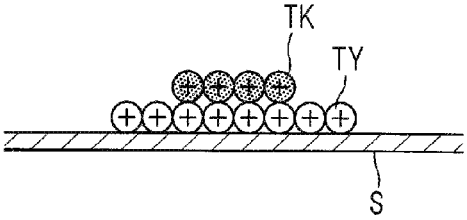
Figure 6G:
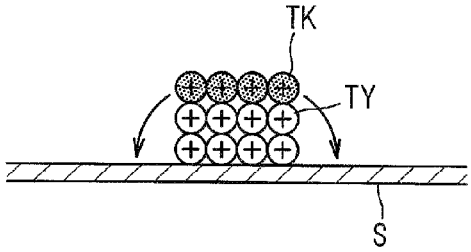

At this time, as shown in FIG. 6E, when the beam diameter of the light beam BY on the photosensitive drum 61Y is small, an area of the illumination part (exposed part) of the light beam BY becomes small. After that, as shown in FIG. 6F, when the yellow toner TY is supplied from the developing roller 63, the toner TY is put on the surface of the photosensitive drum 61Y within the exposed part having the small area in an aggregated state with overlap. Then, as shown in FIG. 60, the toner is transferred from the photosensitive drum 61Y onto the sheet S in the aggregated state. The toner TY transferred onto the sheet S has a thick layer thickness due to the aggregation, so that a potential is entirely increased in a layer of the toner TY.

After that, when the black toner TK is transferred to the toner TY from the photosensitive drum 61K, the toner TK may be scattered by the layer of the toner TY having the high potential toward around the toner TY, so that the toner TK may be directly put on the sheet S. Further, the toner TY which is transferred at the most upstream side in the moving direction of the sheet S is charged up when passing between the photosensitive drums 61M, 61C and the transfer rollers 74. Therefore, since the potential (charge amount) of the toner TY is further increased from the state where the potential is increased due to the aggregation, the toner TK which is transferred at the most downstream side in the moving direction of the sheet S more likely to be scattered, compared to a case where the magenta or cyan toner is transferred onto the toner TY.

In contrast, according to this illustrative embodiment shown in FIG. 6B, when the beam diameter of the light beam BY on the photosensitive drum 61Y is large, an area of the exposed part is increased. After that, as shown in FIG. 6C, when the toner TY is supplied from the developing roller 63, the toner TY is put in a spread state on the exposed part having the large area of the photosensitive drum 61Y and is then transferred from the photosensitive drum 61Y onto the sheet S. Since the toner TY transferred onto the sheet S has a thin layer thickness due to the spreading, a layer of the toner TY can generally suppress increase of the potential.

Accordingly, when the toner TK is transferred from the photosensitive drum 61K onto the toner TY, the toner TK is apt to be put on the toner TY, so that it is possible to favorably overlap the toner TY, TK. As a result, according to the color printer 1, it is possible to suppress deterioration of the image quality which is caused due to the scattering of the toner. In the meantime, even when the toner TY is charged up, increase of the potential of the toner TY just after the transfer is suppressed. Hence, since the increase of the potential due to the charge up can also be suppressed, it is possible to favorably overlap the toner TY TK, also in this case. Further, the toner TY is transferred in a spread state. Therefore, even when the toner TK is scattered due to the charged-up toner TY, it is possible to suppress the toner TK from being directly put on the sheet S while the toner TK moves within the layer of the toner TY.

Additionally, in the above-described configuration where the photosensitive drum 61Y on which the yellow toner image is formed is arranged at the most upstream side in the moving direction of the sheet S and the photosensitive drum 61K on which the black toner image is formed is arranged at the most downstream side, if the black toner is scattered from the underlying of the yellow toner and is thus directly put on the sheet S, the effect of the scattering is more apt to be recognizable, compared to a combination of the other colors. However, according to the color printer 1 of this illustrative embodiment, it is possible to favorably overlap the toner. Thus, it is possible to suppress the black toner from being scattered from the underlying of the yellow toner, so that it is possible to improve the image quality, compared to the related-art technique. Also, the yellow toner is not conspicuous even though it is transferred to the sheet S in a spread state. Thus, it is possible to improve the image quality, compared to a configuration where the toner of another color is transferred at the most upstream side in the moving direction of the sheet S.

Also, in this illustrative embodiment, since the output power of the semiconductor laser LDY is higher than that of the semiconductor laser LDK, it is possible to improve the image quality, compared to a configuration where the beam diameter BDY of the light beam BY is only made to be larger than the beam diameter BDK of the light beam BK. Specifically, in this illustrative embodiment, according to the configuration where the aperture AY of the aperture stop APY is made to be small to thus make the beam diameter BDY of the light beam BY large, the light amount of the laser light passing through the aperture AY is reduced. Therefore, if the output powers of the semiconductor lasers LD are the same, the intensity of the light beam BY on the photosensitive drum 61Y is lower. In this case, a potential difference between the exposed part and the non-exposed part on the photosensitive drum 61Y is reduced, so that the required toner is not sufficiently supplied to the exposed part. As a result, the yellow portion of the image formed on the sheet S may become lighter. However, according to this illustrative embodiment, since the output power of the semiconductor laser LDY is made to be higher, it is possible to secure the intensity of the light beam BY on the photosensitive drum 61Y, so that it is possible to make a potential difference between the exposed part and the non-exposed part large. Thereby, since it is possible to sufficiently supply the required toner to the exposed part, it is possible to solve the problem that the yellow portion becomes lighter, thereby improving the image quality.

[Second Illustrative Embodiment]

In the below, a second illustrative embodiment of the present invention is described. Meanwhile, in the below descriptions, the same constitutional elements as those of the first illustrative embodiment are denoted with the same reference numerals and the descriptions thereof are omitted.

The color printer 1 of the second illustrative embodiment is configured to change the beam diameter of the light beam BY on the photosensitive drum 61Y by moving the aperture stop APY of the light source device 51Y.

Figure 7A:
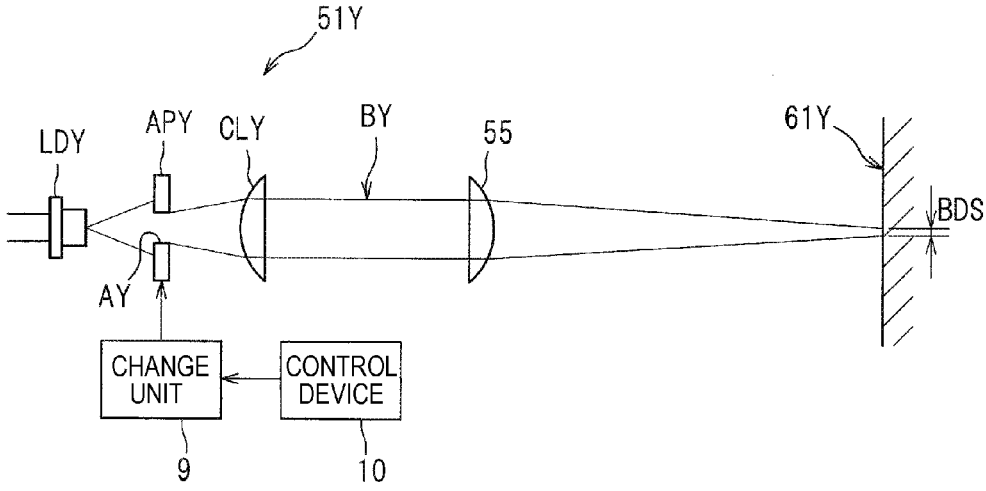
FIGS. 7A and 7B show a configuration of a part of a color printer according to another illustrative embodiment.
Figure 7B:
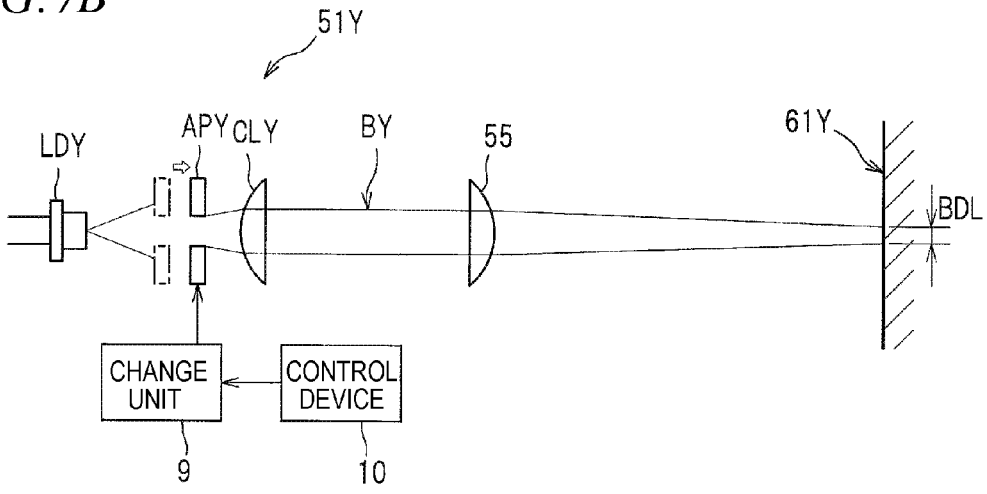

Specifically, the color printer 1 of this illustrative embodiment further includes a change unit 9 and a control device 10, as shown in FIGS. 7A and 7B, in addition to the same configurations (refer to FIGS. 1 to 3) of the first illustrative embodiment. In the color printer 1 of this illustrative embodiment, a size of the aperture AY of the aperture stop APY of the light source device 51Y is the same as those of the apertures of the other aperture stops APM, APC, APK.

The change unit 9 has a mechanism to change a size of the beam diameter BD of the light beam BY on the photosensitive drum 61Y, which is illuminated onto the surface of the photosensitive drum 61Y, by sliding the aperture stop APY in an optical axis direction of the light beam BY, and is provided in the housing 50 of the exposure device 5. The change unit 9 includes a driving source such as motor (not shown), a driving force transmission mechanism configured by a gear and the like for transmitting a driving force from the driving source to the aperture stop APY.

As the change unit 9 moves the aperture stop APY from a position shown in FIG. 7A in a direction approaching the coupling lens CLY as shown in FIG. 7B, the diameter of the laser light on the incident surface of the coupling lens CLY is reduced. Accordingly, since the beam diameter of the light beam BY, which is converted by the coupling lens CL and then is incident on the lens 55, is reduced, the beam diameter of the light beam BY on the photosensitive drum 61Y is increased (the diameter becomes BDL).

Also, as the change unit 9 moves the aperture stop AP from the position shown in FIG. 7B in a direction separating away from the coupling lens CLY as shown in FIG. 7A, the diameter of the laser fight on the incident surface of the coupling lens CLY is enlarged. Accordingly since the beam diameter of the light beam BY, which is converted by the coupling lens CL and then is incident on the fθ lens 55, is increased, the beam diameter of the light beam BY on the photosensitive drum 61Y is decreased (the diameter becomes DDS). Meanwhile, in FIGS. 7A and 7B, the beam diameter BD is more emphasized than in reality.

The control device 10 cont respective units (operations) of the color printer 1 and is arranged at an appropriate position in the body housing 2. The control device 10 has a CPU, a RAM, a ROM, an input/output interface and the like, which are not shown, and executes respective calculation processing based on detection results of various sensors, preset programs and the like to perform control.

The control device 10 is configured to switch between a standard image quality mode and a high image quality mode where a density of a toner image which can be transferred to the sheet S is higher (the number of dots to be transferred is larger) than that of the standard image quality mode based on a user's selection. Specifically, during the high image quality mode, the control device 10 increases the number of times of flashing on and off per unit time of the semiconductor lasers LD when exposing the photosensitive drums 61, compared to the standard image quality. In the meantime, the standard image quality mode and the high image quality mode may be switched by the user operating an operation panel (not shown)

of the color printer 1 and thus selects a mode, or may be switched when the user selects a mode while outputting a print job including print instruction or print data to the color printer 1 from a PC and the like.

In this illustrative embodiment, in the standard image quality mode, the aperture stop APY is located at a position distant from the coupling lens CL as shown in FIG. 7A, and the beam diameter BDS of the light beam BY on the photosensitive drum 61Y is the same as those of the other light beams BM, BC, BK on the photosensitive drums 61M, 61C, 61K. In the high image quality mode (when the mode is switched from the standard image quality mode to the high image quality mode), the control device 10 controls the change unit 9 to move the aperture stop APY to the position shown in FIG. 7B so as to set the beam diameter of the light beam BY on the photosensitive drum 61Y to be the diameter BDL larger than that (BDS) of the standard image quality mode at the time of printing. In contrast, when the mode is switched from the high image quality mode to the standard image quality mode, the control device 10 controls the change unit 9 to move the aperture stop APY from the position shown in FIG. 7B to the position shown in FIG. 7A so as to set the beam diameter of the light beam BY on the photosensitive drum 61Y to be the diameter BDS smaller than that (BDL) of the high image quality mode at the time of printing.

Figure 8:
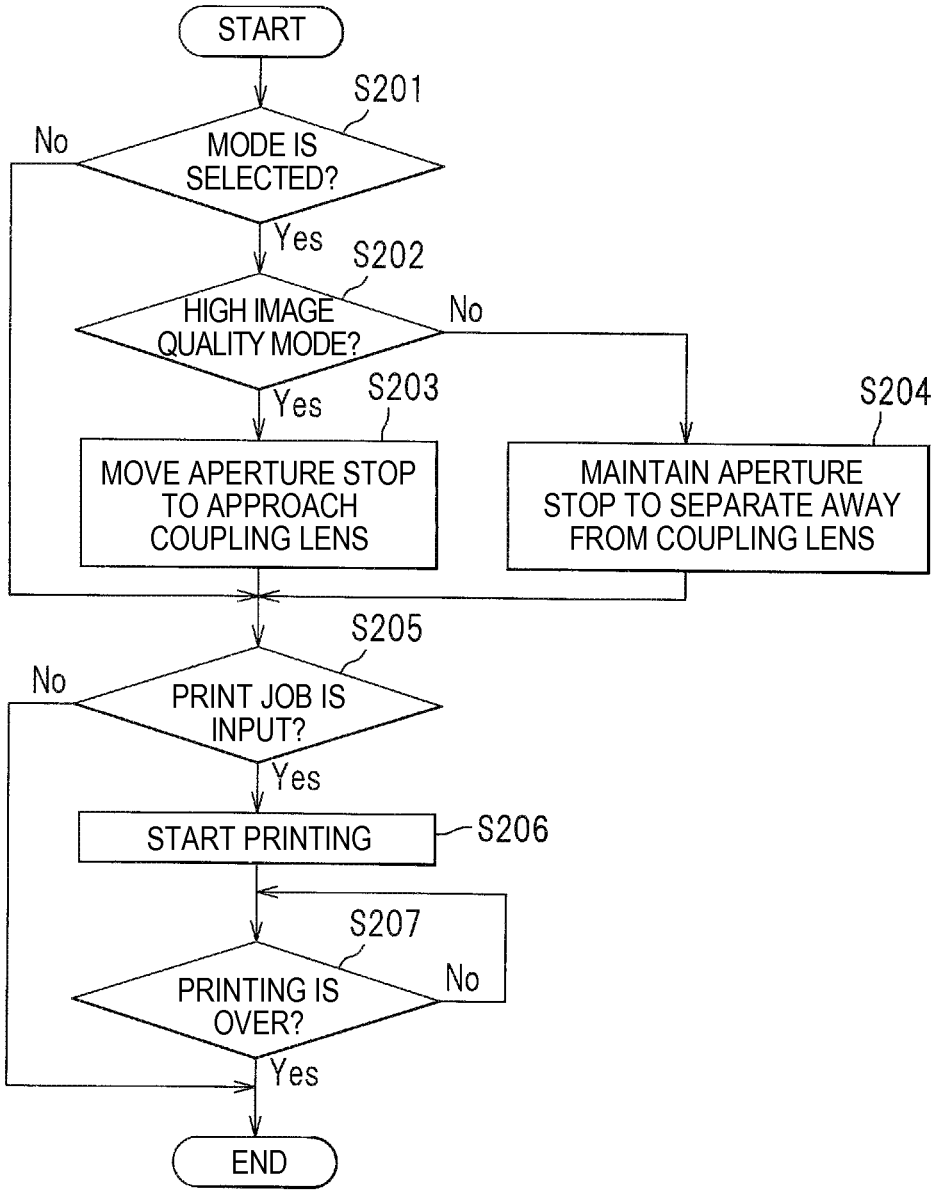
FIG. 8 is a flowchart showing control of a control device according to a second illustrative embodiment.

Meanwhile, the color printer 1 of this illustrative embodiment is configured such that the output power of the semiconductor laser LDY is same as those of the other semiconductor lasers LDM, LDC, LDK in the standard image quality mode. In the high image quality mode, the output power of the semiconductor laser LDY is controlled to be higher than those of the other semiconductor lasers LDM, LDC, LDK by the control device 10. Accordingly, it is possible to solve the problem that the yellow portion becomes lighter, thereby improving the image quality In the below, the control which is executed by the control device 10 is described using a flowchart shown in FIG. 8. The control device 10 repeatedly executes processing of the flowchart shown in FIG. 8.

First, the control device 10 determines whether any mode is selected (S201). When a mode is selected (S201, Yes), the control device 10 determines which mode is selected among the high image quality mode and the standard image quality mode (S202).

When the high image quality mode is selected (S202, Yes), the control device 10 controls the change unit 9 to move the aperture stop APY from the position shown in FIG. 7A to the position shown in FIG. 7B to approach the coupling lens CLY (S203). In contrast, when the standard image quality mode is selected (S202, No), the control device 10 controls the change unit 9 to move the aperture stop APY from the position shown in FIG. 7B to the position shown in FIG. 7A to separate away from the coupling lens CLY (S204). After executing steps S203, S204, the processing proceeds to step S205.

In the meantime, when the aperture stop APY is located at a position corresponding to each mode, the processing proceeds to step S205 without moving the aperture stop APY. Also, in step S201, when a mode is not selected (S201, No), the control device 10 maintains the current mode (maintains the position of the aperture stop APY) and the processing proceeds to step S205.

In step S205, the control device 10 determines whether a print job is input. When a print job (print data) is input (S205, Yes), the control device 10 starts a printing (S206). After that, the control device 10 determines whether the printing is over (S207). When the printing is over (S207, Yes), the control device 10 ends the processing of the flowchart shown in FIG. 8. On the other hand, in step S205, when a print job (print data) is not input (S205, No), the control device 10 ends the processing of the flowchart shown in FIG. 8.

According to this second illustrative embodiment, it is possible to obtain the same effects as those of the first illustrative embodiment.

Also, in the color printer 1 capable of executing the high image quality mode where the number of dots to be transferred to the sheet S is large, variation in gradation is apt to occur in an image due to the scattering of the toner, particularly in the high image quality mode. However, according to the second illustrative embodiment, since the toner can be favorably overlapped, it is possible to obtain an image of a favorable gradation.

[Third Illustrative Embodiment]

In the below, a third illustrative embodiment of the present invention is described. The configurations and controls of this third illustrative embodiment are the same as those of the second illustrative embodiment, except that a part of the operations (a condition for moving the aperture stop APY) of the control device 10 is different from the second illustrative embodiment.

The control device 10 of this illustrative embodiment is configured to determine whether the input print data includes a color image, specifically; a color photograph image. The determination can be made by a known method, and thus, the detailed descriptions thereof are omitted.

When the print data including a color photograph image (hereinafter, referred to as photograph data) is input, the control device 10 controls the change unit 9 to move the aperture stop APY from the position shown in FIG. 7A to the position shown in FIG. 7B so as to set the beam diameter of the light beam BY on the photosensitive drum 61Y to be larger during the printing, compared to a case where print data of another type, for example, print data configured by only characters (hereinafter, referred to as character data) is input. When the character data is input, the control device 10 maintains the aperture stop AP at the position shown in FIG. 7A.

The control device 10 controls the output power of the semiconductor laser LDY to be same as those of the other semiconductor lasers LDM, LDC, LDK during the printing which is executed when the character data is input. The control device 10 controls the output power of the semiconductor laser LDY to be higher than those of the other semiconductor lasers LDM, LDC, LDK during the printing which is executed when the photograph data is input.

Figure 9:
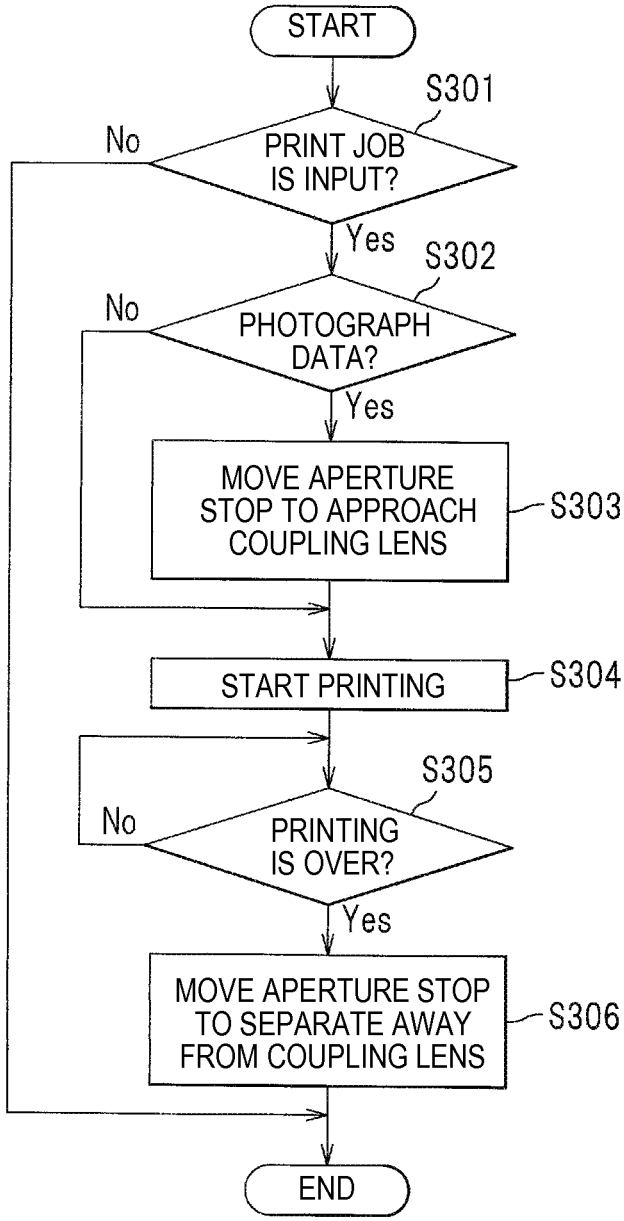
FIG. 9 is a flowchart showing control of a control device according to a third illustrative embodiment.

Subsequently, the control of the control device 10 of this illustrative embodiment is described with reference to a flowchart shown in FIG. 9. The control device 10 repeatedly executes processing of the flowchart shown in FIG. 9.

First, the control device 10 determines Whether a print job is input (S301). When a print job is input (S301, Yes), the control device 10 determines whether the input print job is the photograph data (S302).

When the input print job is the photograph data (S302, Yes), the control device 10 controls the change unit 9 to move the aperture stop APY from the position shown in FIG. 7A to the position shown in FIG. 7B to approach the coupling lens CLY (S303) and starts a printing (S304). In contrast, when the input print job is not the photograph data (for example, the input print job is the character data) (S302, No), the control device 10 maintains the aperture stop APY at the position shown in FIG. 7A and starts a printing (S304).

After that, the control device 10 determines whether the printing is over (S305). When the printing is over (S305, Yes), the control device 10 returns the aperture stop APY to its original position if the aperture stop APY is located at the position shown in FIG. 7A (S306), and ends the processing of the flowchart shown in FIG. 9.

According to this third illustrative embodiment as described above, it is possible to obtain the same effects as those of the first illustrative embodiment, Variation of gradation is apt to occur in the color image having the large number of colors such as color photograph image, due to the scattering of the toner. However, according to this illustrative embodiment, the beam diameter of the light beam BY on the photosensitive drum 61Y is enlarged during the printing which is executed when the photograph data is input. Accordingly, since the toner can be favorably overlapped, it is possible to obtain an image of a favorable gradation.

While the present invention has been shown and described with reference to certain illustrative embodiments thereof, it will be understood by those skilled in the art that various changes in form and details may be made therein without departing from the spirit and scope of the invention as defined by the appended claims.

In the first illustrative embodiment, the exposure device 5 is configured such that the beam diameters of the light beams BM, BC, BK on the photosensitive drums 61M, 61C, 61K are same and only the beam diameter of the light beam BY on the photosensitive drum 61Y is made larger than the others. However, the present invention is not limited thereto. For example, referring to FIGS. 2 and 3, the exposure device 5 may be configured such that the beam diameter of the light beam B to be illuminated on the photosensitive drum 61 arranged at a more upstream side in the moving direction of the sheet S is larger. That is, the exposure device 5 may be configured such that the beam diameters on the photosensitive drums 61 become larger in order from the light beams BK, BC, BM, BY Specifically, when the sizes of the apertures of the aperture stops AP are smaller in order from APK, APC, APM, APY, this configuration can be implemented. According to this configuration, it is possible to favorably overlap the downstream toner over the toner transferred onto the sheet S at the upstream side.

Also, for example, the exposure device 5 may be configured such that the beam diameters of the light beams BY, BM on the photosensitive drums 61Y, 61M are same as each other and are larger than the beam diameters of the light beams BC, BK on the photosensitive drums 61C, 61K. Also, the exposure device 5 may be configured such that the beam diameters of the light beams BY, BM, BC on the photosensitive drums 61Y, 61M, 61C are the same as one another and are larger than the beam diameter of the light beam BK on the photosensitive drum 61K.

In the second and third illustrative embodiments, when the standard image quality mode is selected or when the character data is input, the beam diameter of the light beam BY on the photosensitive drum 61Y is same as the beam diameters of the other light beams BM, BC, BK on the photosensitive drums 61M, 61C, 61K. However, the present invention is not limited thereto. For example, when the standard image quality mode is selected or when the character data is input, the beam diameter of the light beam BY on the photosensitive drum 61Y may be larger than the beam diameters of the other light beams BM, BC, BK on the photosensitive drums 61M, 61C, 61K. In this case, when the high image quality mode is selected or when the photograph data is input, the aperture stop APY is moved towards the coupling lens CLY, such that the beam diameter of the light beam BY on the photosensitive drum 61Y becomes larger than a beam diameter which is formed when the standard image quality mode is selected or the character data is input.

The specific configuration of the change unit 9 described in the second and third illustrative embodiments is just exemplary and the present invention is not limited to the configuration of the illustrative embodiments, For example, the change unit may be configured to move one of the plurality of aperture stops haying different aperture diameters on a light path of the light beam, depending on the selected mode or print data. Also, the change unit may be configured to guide a member such as opaque glass which enables the light beam to transmit therethrough while spreading it, on the light path of the light beam when enlarging the beam diameter of the light beam on the photosensitive drum.

In the third illustrative embodiment, the photograph image has been exemplified as the color image. However, the present invention is not limited thereto. For example, the color image may be an image (halftone image) having a gradation other than the photograph image, an image having many solid fills, and the like.

In the above illustrative embodiments, the photosensitive drums 61Y, 61M, 61C, 61K are arranged side by side in corresponding order from the upstream side in the conveyance direction of the sheet S. However, the present invention is not limited thereto. The arrangement order of the photosensitive members (arrangement of colors) may be arbitrary.

The specific configuration of the exposure device 5 described in the above illustrative embodiments is exemplary and the present invention is not limited to the configuration of the illustrative embodiments. For example, in the exposure device 5 of the above illustrative embodiments, the aperture stop AP is arranged between the semiconductor laser LD and the coupling lens CL. However, the present invention is not limited thereto. For example, the aperture stop may be arranged at the downstream side from the coupling lens in a traveling direction of the light beam. Also, the exposure device 5 of the above illustrative embodiments has the polygon mirror 54 which rotates to deflect the light beam. However, the present invention is not limited thereto. For example, a vibration mirror which vibrates to thus deflect the light beam may be provided instead of the polygon mirror.

In the above illustrative embodiments, the sheet S is exemplified as a transferred medium. However, the present invention is not limited thereto. For example, the transferred medium may be a so-called intermediate transfer belt and the like. In other words, the present invention is not limited to the printer which directly transfers the developer image on the photosensitive member to the sheet and can be also applied to an intermediate transfer-type printer.

In the above illustrative embodiments, the light beam is the parallel light flux. However, the present invention is not limited thereto. For example, beam may be a convergent light flux or divergent light flux.

In the above illustrative embodiments, the color printer 1 (printer) is exemplified as the image forming apparatus. However, the present invention is not limited thereto. For example, the image forming apparatus may be a copier, a complex machine and the like having a document reading device such as flat bed scanner. Also, in the above illustrative embodiments, the image forming apparatus using the positively chargeable toner (developer) is exemplified. However, the present invention is not limited thereto. That is, the present invention can be also applied to an image forming apparatus using negatively chargeable toner.

What is claimed is:

1. An image forming apparatus comprising:

a plurality of photosensitive members which are arranged in parallel and on which developer images are formable by supplying developer to electrostatic latent images, respectively; and an exposure device which is configured to illuminate light beams onto surfaces of the photosensitive members to form the electrostatic latent images, respectively, wherein the developer images on the respective photosensitive members are transferred to a transferred medium which is moved in a moving direction along an arrangement direction of the photosensitive members while contacting the respective photosensitive members, and wherein the exposure device is configured such that a beam diameter of a light beam exposing a surface of a most-upstream photosensitive member arranged at a most upstream side in the moving direction is larger than a beam diameter of a light beam exposing a surface of a most-downstream photosensitive member arranged at a most downstream side in the moving direction.

2. The image forming apparatus according to claim 1, wherein a yellow developer image is formed on the most-upstream photosensitive member, and a black developer image is formed on the most-downstream photosensitive member.

3. The image forming apparatus according to claim 1, further comprising:

a control device which is configured to switch between a standard image quality mode and a high image quality mode in which a density of a developer image which can be transferred to the transferred medium is higher than that of the standard image quality mode; and a change unit which is configured to change a size of the beam diameter of the light beam exposing the most-upstream photosensitive member on the surface thereof, wherein, in the high image quality mode, the control device controls the change unit to set the beam diameter of the light beam exposing the surface of the most-upstream photosensitive member to be larger than that of the standard image quality mode.

4. The image forming apparatus according to claim 1, wherein the exposure device is configured such that a beam diameter of light beam on a surface of a photosensitive member arranged at a more upstream side in the moving direction is larger.

5. The image forming apparatus according to claim 1, further comprising:

a change unit which is configured to change a size of the beam diameter of the light beam exposing the surface of the most-upstream photosensitive member; and a control device which is configured, when print data including a color image is input, to control the change unit to set the beam diameter of the light beam exposing the surface of the most-upstream photosensitive member to be larger than that when print data configured only by a character is input.

6. The image forming apparatus according to claim 5, wherein the color image is a photograph image.

7. The image forming apparatus according to claim 1, wherein the exposure device is configured such that an output power of a light source configured to emit the light beam to the most-upstream photosensitive member is higher than an output power of a light source configured to emit the light beam to the most-downstream photosensitive member.

8. An image forming apparatus comprising:

a conveyance belt which is configured to convey a sheet;

a plurality of photosensitive drums Which are arranged in parallel to face the conveyance belt and include a first photosensitive drum arranged at a most upstream side in a moving direction of the conveyance belt and a second photosensitive drum arranged at a most downstream side in the moving direction of the conveyance belt; and an exposure device which includes a first light source configured to emit a light beam to expose the first photosensitive drum and a second light source configured to emit a light beam to expose the second photosensitive drum and configured such that a beam diameter of the light beam exposing the first photosensitive drum is larger than a beam diameter of the light beam exposing the second photosensitive drum.

9. The image forming apparatus according to claim 8, wherein the first photosensitive drum is configured to carry yellow developer, and wherein the second photosensitive drum is configured to carry black developer.

10. The image forming apparatus according to claim 8, further comprising:

a change unit which is configured to change a size of the beam diameter of the light beam exposing the first photosensitive drum; and a control device which is configured to switch between a standard image quality mode and a high image quality mode in which a density of a developer image which can be transferred to the sheet is higher than that of the standard image quality mode, and to control the change unit, in the high image quality mode, to set the beam diameter of the light beam exposing the first photosensitive drum to be larger than that of the standard image quality mode.

11. The image forming apparatus according to claim 8, wherein the exposure device is configured such that a beam diameter of a light beam exposing a photosensitive drum arranged at a more upstream side in the moving direction of the conveyance belt is larger.

12. The image forming apparatus according to claim 8, further comprising:

a change unit which is configured to change a size of the beam diameter of the light beam exposing the first photosensitive drum; and a control device which is configured, when print data including a color image is input, to control the change unit to set the beam diameter of the light beam exposing the first photosensitive drum to be larger than that en print data configured only by a character is input.

13. The image forming apparatus according to claim 12, wherein the color image is a photograph image.

14. The image forming apparatus according to claim 8, wherein the exposure device is configured such that an output power of the first light source is higher than an output power of the second light source.

* * * * *